US005899669A

United States Patent [19]

Van Grimberge

[11] Patent Number: 5,899,669

[45] Date of Patent: May 4, 1999

[54] COMPRESSOR DEVICE WITH VIBRATION ISOLATOR

[75] Inventor: Guido René Louisa Van Grimberge, Aartselaar, Belgium

[73] Assignee: Atlas Copco Airpower, naamloze vennootschap, Wilrijk, Belgium

[21] Appl. No.: 08/825,705

[22] Filed: Mar. 19, 1997

[30] Foreign Application Priority Data

Mar. 19, 1996 [BE] Belgium ..... 09600243

[51] Int. Cl.[6] ..... F04B 23/00

[52] U.S. Cl. ..... 417/243; 417/354; 417/363; 285/301

[58] Field of Search ..... 417/254, 363, 417/243; 285/301, 114, 49, 45, 286, 226, 90; 165/9, 10; 181/207; 248/20; 62/175

[56] References Cited

U.S. PATENT DOCUMENTS

| | | | |
|---|---|---|---|
| 3,360,958 | 1/1968 | Miner | 62/470 |
| 3,469,809 | 9/1969 | Reznick et al. | 248/20 |
| 4,462,460 | 7/1984 | Braver | 165/26 |
| 4,946,351 | 8/1990 | Richardson | 417/363 |
| 5,145,215 | 9/1992 | Udell | 285/49 |
| 5,236,311 | 8/1993 | Lindstrom | 417/254 |
| 5,277,554 | 1/1994 | Elson | 417/363 |
| 5,370,427 | 12/1994 | Hoelle et al. | 285/301 |

FOREIGN PATENT DOCUMENTS 275853 12/1913 Germany .

*Primary Examiner*—Timothy S. Thorpe
*Assistant Examiner*—Robert Z. Evora
*Attorney, Agent, or Firm*—Bacon & Thomas, PLLC

[57] ABSTRACT

A compressor device, more particularly a two-stage compressor device (1), consists of a low-pressure compressor (4), a first compartment (7) of a cooling part (6) connected to the low-pressure compressor (4) by a first flexible connector (21), a high-pressure compressor (5) which is connected to the exit (11) of the first compartment (7), a second compartment (8) of the cooling part (6) which is connected to high-pressure compressor (5) by a second flexible connector (22), and a conduit (15) which is connected to the exit of the second compartment (8) for the discharge of the compressed gas. Flexible connections (21–22) are situated at opposite sides of a compression part (3) formed by the low-pressure compressor (4) and the high-pressure compressor (5), such that flexible connectors (21–22) extend substantially opposite each other. The arrangement of flexible connectors (21–22) in compressor device (1) avoids the transmission of movements and vibrations from compression part (3) to cooling part (6).

11 Claims, 1 Drawing Sheet

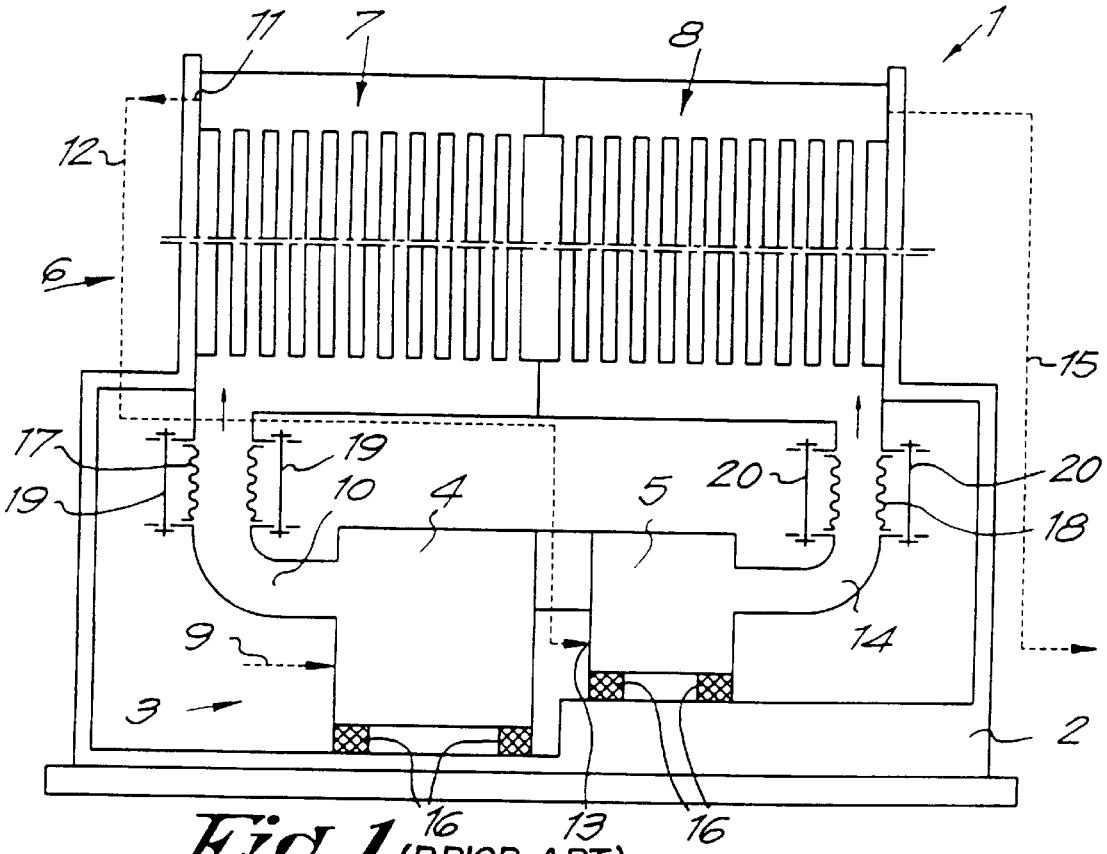
Fig. 1 (PRIOR ART)
Fig. 2
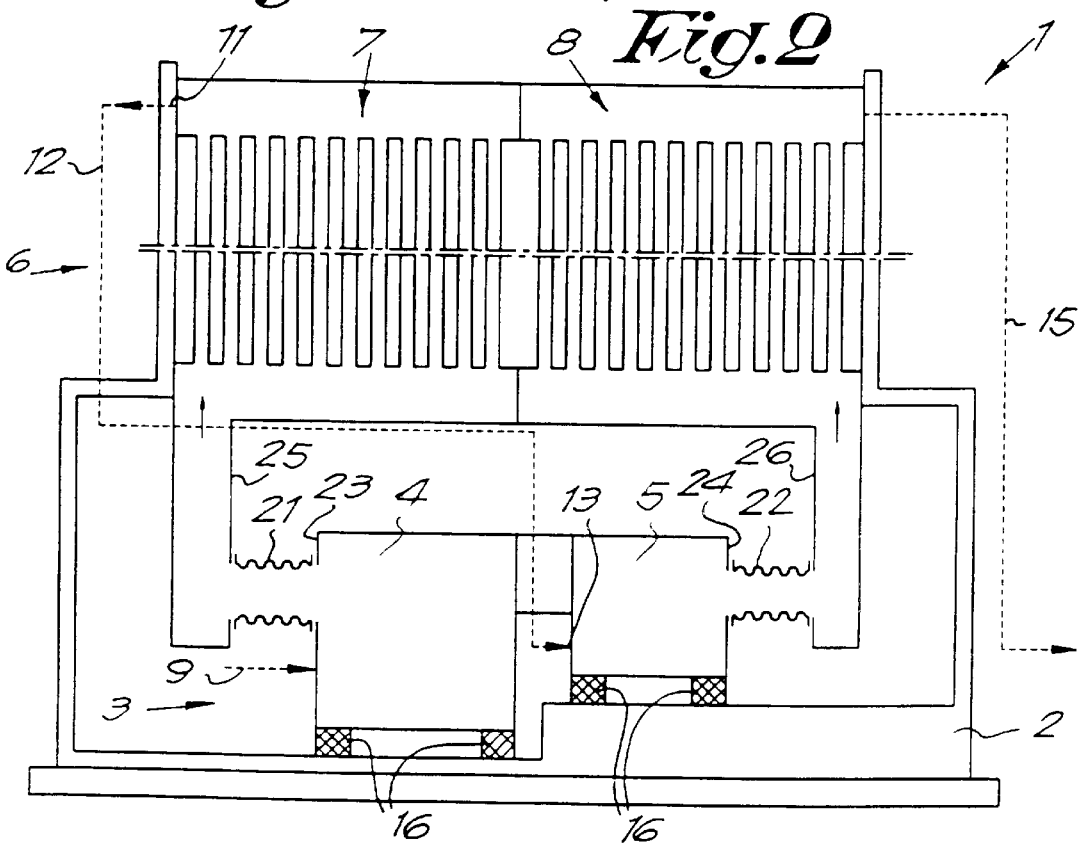

COMPRESSOR DEVICE WITH VIBRATION ISOLATOR

BACKGROUND OF THE INVENTION

1. Field of the Invention

This invention relates to a compressor device for vibration-free displacement of gases, air or liquid from a moving part of the compressor to a motion-free part of the compressor, such that no transmission of movements or vibrations to the motion-free part of this device occurs.

2. Discussion of the Related Art

It is known to cool gases during their compression. Known compressor devices thus consist of a compression part and a cooling part.

In order to avoid damage to the generally very sensitive cooling part construction caused by the heavy vibrations generated in the compression part, it is known to place the compression part, which includes at least the compressors and possibly their driving motors, upon rubber blocks and to provide a flexible connection between the compression part and the cooling part. The cooling part is itself mounted fixedly.

In a two-stage compressor device, it is also known to direct a gas, compressed in a low-pressure stage, via a first flexible connection to a first compartment of a cooling part. The gas discharged from this first compartment is supplied to a high-pressure stage. The gas, compressed in the high-pressure stage, is then directed via a second flexible connection to a second compartment of the cooling part. The gas cooled in this second compartment is finally discharged for usage.

In a known embodiment, two flexible connections in the form of bellows are connected between flanges attached, on one hand, at the compression part and, on the other hand, at the cooling part. These flanges are connected to each other by means of tension rods.

This known embodiment has the disadvantage of only allowing for a two-dimensional displacement of the compression part, placed upon rubber blocks, with respect to the cooling part. Furthermore, the tension rods transmit vibrations from the compression part to the cooling part.

SUMMARY OF THE INVENTION

The present invention has as an object a compressor device of the above-described known type which does not have the aforementioned disadvantages.

To this aim, the invention consists of a compressor device, for example a two-stage compressor device, which includes a low-pressure compressor and a high pressure compressor. A first compartment of a cooling part is connected to the low-pressure compressor by means of a first flexible connection. The high-pressure compressor is connected to the exit of this first compartment. A second compartment of the cooling part is connected to the high-pressure compressor by means of a second flexible connection. A discharge for the consumption of the compressed gas is connected to the exit of the second compartment. The first and second flexible connections are situated at opposite sides of the compression part formed by the low-pressure compressor and the high-pressure compressor. These flexible connections mainly extend opposite each other.

Because the flexible connections extend opposite each other, an advantage is realized in that the compression part, which generally is placed upon rubber blocks or the like, can perform a three-dimensional displacement with respect to the generally fixedly mounted cooling part. Therefore, the invention optimally avoids damage to the cooling part from any heavy vibrations created in the compression part.

In a preferred embodiment, the flexible connections are free from additional connections, such as the aforementioned tension rods. As a result, the construction is considerably simpler and the transmission of vibrations through connections is avoided in an optimum manner.

The two flexible connections are preferably situated precisely opposite each other. Opposing actions are thus realized in the two connections, such that a compensation of forces is obtained, enhancing the stability of the whole unit.

In the most preferred embodiment, the flexible connections extend precisely along a common axis.

According to the invention, however, the flexible connections may extend at somewhat of an angle with respect to each other. Indeed, it is clear that with such an inclined positioning, a three-dimensional displacement between the compression part and the cooling part is still possible and that the effect aimed at according to the invention is still achieved, but only to a lesser extent.

Preferably, the compression part is mounted in a movable manner by placing it upon rubber blocks or the like. The cooling part is preferably fixed. According to the invention, however, the cooling part may be supported in a movable and/or elastic manner.

Furthermore, the invention includes embodiments in which the compressors are fixedly mounted on the frame of the compressor device and the cooling device is mounted on the frame in a movable manner.

The flexible connections may be of varying nature. In consideration of the high pressures which occur with such two-stage compressor devices, the connections are preferably bellows made, for example, of metal.

BRIEF DESCRIPTION OF THE DRAWINGS

To more clearly show the characteristics of the invention, a preferred embodiment is described in the following, as an example without any limitative character, with reference to the accompanying drawings, wherein:

FIG. 1 schematically shows a known compressor device;

FIG. 2 schematically shows a compressor device according to the invention.

DESCRIPTION OF THE PREFERRED EMBODIMENT

A compressor device 1, shown schematically in FIG. 1, mainly consists of a support frame 2, a compression part 3 with a low-pressure compressor 4 and a high-pressure compressor 5, and a cooling part 6 with a first compartment 7 and a second compartment 8.

Low-pressure compressor 4 and first compartment 7 form a so-called low-pressure stage. High-pressure compressor 5 and second compartment 8 form a so-called high-pressure stage.

A gas to be compressed is aspired via an entrance 9 into low-pressure compressor 4. Via an outlet conduit 10, the compressed gas is supplied to an inlet of the first compartment 7, where it is cooled. From an outlet 11, the cooled gas, by means of inlet conduit 12, is supplied to an inlet 13 of high-pressure compressor 5. From there, the gas compressed under high pressure is supplied via an outlet conduit 14 to an inlet of second compartment 8. The gas is supplied subsequently via an outlet conduit 15 to a consumer.

Compression part 3, more particularly compressors 4 and 5 including their corresponding drives, is fixed in a movable manner onto frame 2 by means of rubber blocks 16.

As mentioned previously, it is known to provide a first flexible connection 17 between low-pressure compressor 4, more particularly conduit 10, and first compartment 7 of cooling part 6. Also, a second flexible connection 18 is provided between high-pressure compressor 5, more particularly conduit 14, and second compartment 8. According to this known embodiment, an additional fixation or restraint has to be provided by means of tension rods 19 and 20 in order to prevent the whole unit from being pressed apart by the occurring gas forces.

In FIG. 2, a compressor device 1 according to the invention is shown. The parts which correspond to the parts of FIG. 1 are indicated with the same reference numerals.

As shown in FIG. 2, flexible connections 21 and 22 are provided at opposite sides of compression part 3. In particular, flexible connections 21 and 22 extend with their flow directions in a direction opposing each other, which leads to the advantages mentioned previously.

Preferably, connections 21 and 22 shall be situated precisely opposite each other on a common axis.

Connections 21 and 22 consist only of flexible elements, such as bellows, for example. In other words, connections 21 and 22 are free of other connection elements, more particularly free of rigid restraining elements such as the aforementioned tension rods 19 and 20.

Analogous to FIG. 1, compression part 3 is mounted in a movable manner, as it is placed upon rubber blocks 1 6 on frame 2. Cooling part 6 is mounted on frame 2 in a fixed manner.

Compressors 4 and 5, which may or may not have a common drive, are preferably connected rigidly to each other to form a single unit. The same applies to compartments 7 and 8.

It has to be noted that flexible connections 21 and 22 at their extremities preferably are fitted laterally between rigid parts 23 and 24, which are part of and/or are connected to compression part 3, and rigid parts 25 and 26, which are part of and/or are connected to cooling part 6. Rigid parts 25 and 26 grip around rigid parts 23 and 24 such that an optimum compensation of vibration forces is performed.

Due to all of these characteristics of the invention, vibrations are compensated for considerably better than in the known embodiment of FIG. 1. A great number of vibrations compensate for each other because of the opposite positioning of flexible connections 21 and 22.

The present invention is in no way limited to the embodiment described and represented above as an example; on the contrary, such a compressor device can be realized in various forms and dimensions without leaving the scope of the invention.

Thus, for example, one or several pressure stages can be applied, wherein the connections between compression part 3 and cooling part 6, regardless if two or more than two connections are concerned, extend laterally and are situated at opposite sides of compression part 3.

I claim:

1. A two-stage compressor device (1), comprising: a low-pressure compressor (4) having an outlet; a cooling part located adjacent the compressor device and (6) having a first compartment (7); a first flexible connector (21); the first compartment having an inlet connected to the outlet of the low-pressure compressor (4) of the first flexible connector and an outlet; a high-pressure compressor (5) having an inlet in fluid communication with the outlet (11) of the first compartment (7) and an outlet; a first and second compartment (8) of the cooling part (6) with a pair of rigid extensions (25) extending at least to the outlets of the low and high-pressure compressors respectively; a second flexible connector (22); the second component having an inlet connected to the outlet of the high-pressure compressor (5) by the second flexible connector and an 10 outlet; and a conduit (15) connected to the outlet of the second compartment (8) for the discharge of the compressed gas, wherein the flexible connectors (21–22) are disposed on opposite sides of a compression part (3), formed by the low-pressure compressor (4) and the high-pressure compressor (5), between the compression part (3) and the rigid extensions (25, 26) said flexible connectors (21–22) extending substantially in opposite directions from each other.

2. A compressor device according to claim 1, wherein the flexible connectors (21–22) are located exactly opposite each other on the opposite sides of compression part (3) having a coincident longitudinal axis.

3. A compressor device according to claim 1, wherein the low-pressure and high-pressure compressors are horizontally spaced apart and the flexible connectors (21–22) extend in a substantially horizontal direction.

4. A compressor device according to claim 1, wherein the flexible connectors (21–22) are located along a common axis.

5. A compressor device according to claim 1, wherein the flexible connectors (21–22) are unrestrained in any direction by any other connectors extending between the outlets of the compressors and the inlets of the cooling part.

6. A compressor device according to claim 1, wherein the flexible connectors (21–22) comprise bellows.

7. A compressor device according to claim 1, wherein the compression part (3) is moveable with respect to a support frame (2) and the cooling part (6) is fixedly attached with respect to the support frame (2).

8. A compressor device according to claim 7, including elastic elements disposed between the compression part and the support frame.

9. A compressor device according to claim 8, wherein the elastic elements are formed of rubber.

10. A compressor device according to claim 1, wherein the flexible connectors are captured directly between the compressor and the rigid extensions (25, 26) wherein each of the flexible connectors (21, 22) have a length confined between one of the compressors (4, 5) and the corresponding rigid extensions (25, 26).

11. A compressor device according to claim 1, wherein said low pressure and high pressure compressors are rigidly connected together.

* * * * *